US009577381B2

(12) United States Patent
Shi et al.

(10) Patent No.: US 9,577,381 B2
(45) Date of Patent: Feb. 21, 2017

(54) ELECTRICAL CONNECTOR

(71) Applicant: Tyco Electronics (Shanghai) Co. Ltd., Shanghai (CN)

(72) Inventors: Ming Shi, Shanghai (CN); Xiang Xu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/721,278

(22) Filed: May 26, 2015

(65) Prior Publication Data

US 2015/0340810 A1 Nov. 26, 2015

(30) Foreign Application Priority Data

May 26, 2014 (CN) ..... 2014 2 0272363 U

(51) Int. Cl.

| | |
|---|---|
| ***H01R 13/639*** | (2006.01) |
| ***H01R 4/24*** | (2006.01) |
| ***H01R 12/75*** | (2011.01) |
| *H01R 12/72* | (2011.01) |

(52) U.S. Cl.

CPC ..... *H01R 13/639* (2013.01); *H01R 4/2404* (2013.01); *H01R 12/75* (2013.01); *H01R 12/721* (2013.01)

(58) Field of Classification Search

USPC ..... 439/352, 353, 345, 723, 872, 857, 700,439/806

See application file for complete search history.

(56) References Cited

U.S. PATENT DOCUMENTS 3,346,834 A * 10/1967 Kinkaid ..... H01R 13/20 439/723
3,656,093 A * 4/1972 Kinkaid ..... H01R 12/721 439/636
3,727,170 A * 4/1973 Mosier ..... H01R 12/79 439/493
4,023,879 A * 5/1977 Braund ..... H01R 13/26 439/172
4,402,564 A * 9/1983 Frantz ..... H01R 12/79 439/350
4,784,623 A * 11/1988 Beck, Jr. ..... H01R 12/68 439/422
4,790,760 A * 12/1988 Kreinberg ..... H01R 12/7088 439/55
4,954,090 A * 9/1990 Shimochi ..... H01R 9/2458 439/329
5,141,449 A * 8/1992 Tieszen ..... F21V 21/002 439/419
5,192,234 A * 3/1993 Heng ..... H01R 4/363 439/709
6,250,966 B1 * 6/2001 Hashimoto ..... H01R 12/774 439/495
6,347,031 B1 * 2/2002 Kawamoto ..... H01R 13/11 361/212

(Continued)

*Primary Examiner* — Alexander Gilman
(74) *Attorney, Agent, or Firm* — Barley Snyder

(57) ABSTRACT

An electrical connector includes an insulation body and a contact. The insulation body includes a first side and a second side positioned opposite to the first side. The contact is received in the insulation body and includes a first elastic gripping portion adjacent to the first side of the insulation body and a second elastic gripping portion adjacent to the second side of the insulation body.

26 Claims, 10 Drawing Sheets

(56) References Cited

U.S. PATENT DOCUMENTS

| | | | | |
|---|---|---|---|---|
| 6,364,702 | B1 * | 4/2002 | Mochizuki | H01R 24/62 439/499 |
| 8,038,467 | B2 * | 10/2011 | Shen | H01R 23/667 439/260 |
| 8,998,618 | B2 * | 4/2015 | Hashiguchi | H01R 13/113 439/12 |
| 9,281,621 | B2 * | 3/2016 | Tian | H01R 13/6463 |
| 2006/0073742 | A1 * | 4/2006 | Cisey | H01R 4/48 439/857 |
| 2010/0173531 | A1 * | 7/2010 | Holste | H01R 4/4836 439/700 |
| 2013/0237072 | A1 * | 9/2013 | Keswani | H01R 25/142 439/110 |

* cited by examiner

ELECTRICAL CONNECTOR

CROSS-REFERENCE TO RELATED APPLICATION

This application claims the benefit of the filing date under 35 U.S.C. §119(a)-(d) or (f) of Chinese Patent Application No. 201420272363.6 filed on May 26, 2014.

FIELD OF THE INVENTION

The present invention relates to an electrical connector and, more particularly, to an electrical connector for a tape-like electrical device.

BACKGROUND

In normal use, a tape-like LED (light-emitting diode) lamp is generally electrically connected to a wire or another tape-like LED lamp. In the prior art, a known tape-like LED lamp is electrically connected to the wire or another tape-like LED lamp through manual soldering. During the manual soldering, a special tool and a power supply are needed. Thereby, it is not convenient to electrically connect the tape-like LED lamp. Furthermore, the process of manual soldering is very complicated, decreasing the electrical connection efficiency. Moreover, the soldering quality is not reliable, often needing to re-solder, and the maintenance is difficult.

SUMMARY

The present invention has been made to overcome or alleviate at least one aspect of the above mentioned disadvantages, among others.

Accordingly, an electrical connector includes an insulation body and a contact. The insulation body includes a first side and a second side positioned opposite to the first side. The contact is received in the insulation body and includes a first elastic gripping portion adjacent to the first side of the insulation body and a second elastic gripping portion adjacent to the second side of the insulation body.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EMBODIMENT(S)

Figure 1:
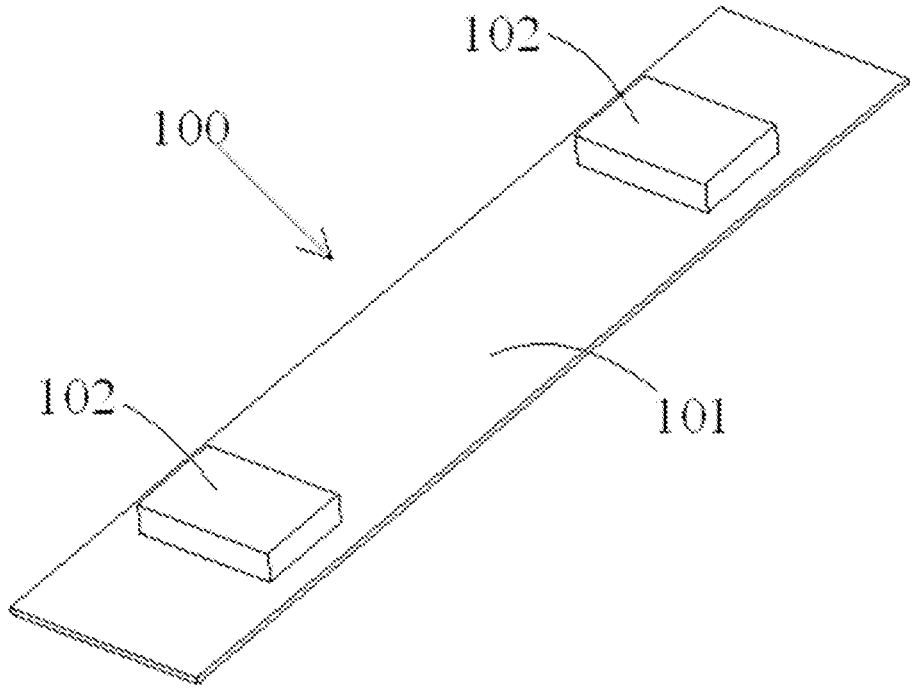
FIG. 1 is a perspective view of a known tape-like LED lamp device.

Exemplary embodiments of the present invention will be described hereinafter in detail with reference to the attached drawings, wherein the like reference numerals refer to the like elements. The present invention may, however, be embodied in many different forms and should not be construed as being limited to the embodiments set forth herein; rather, these embodiments are provided so that the disclosure of the present invention will be thorough and complete, and will fully convey the concept of the present invention to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 8:
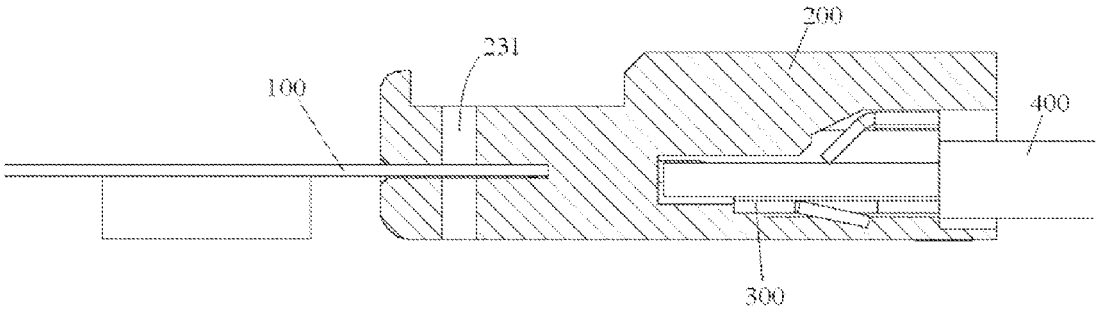
FIG. 8 is a section view of the electrical connector according to the invention showing insertion of a tape-like LED lamp device and a wire into the insulation body of FIG. 3.

According to a general concept of the invention, and as shown in FIG. 8, an electrical connector is provided for electrically connecting a first device 100 and a second device 400. The electrical connector generally includes an insulation body 200 and a contact 300.

Figure 3:
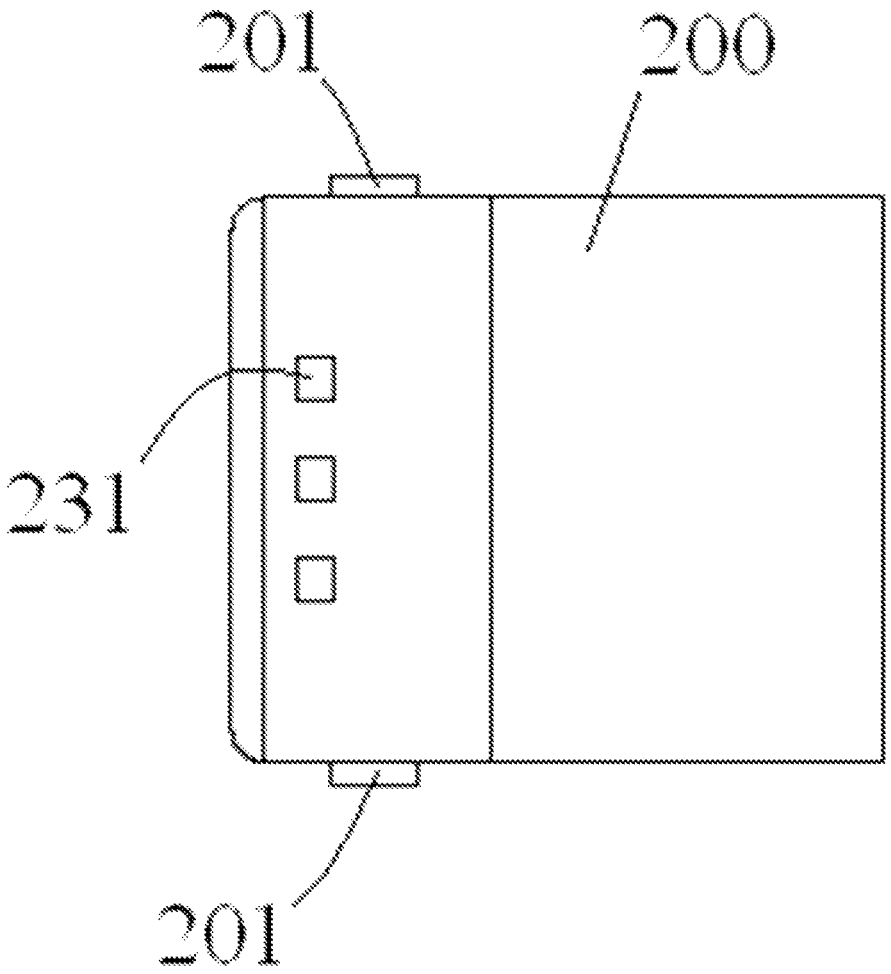
FIG. 3 is a top view of an insulation body of an electrical connector according to the invention.
Figure 5:
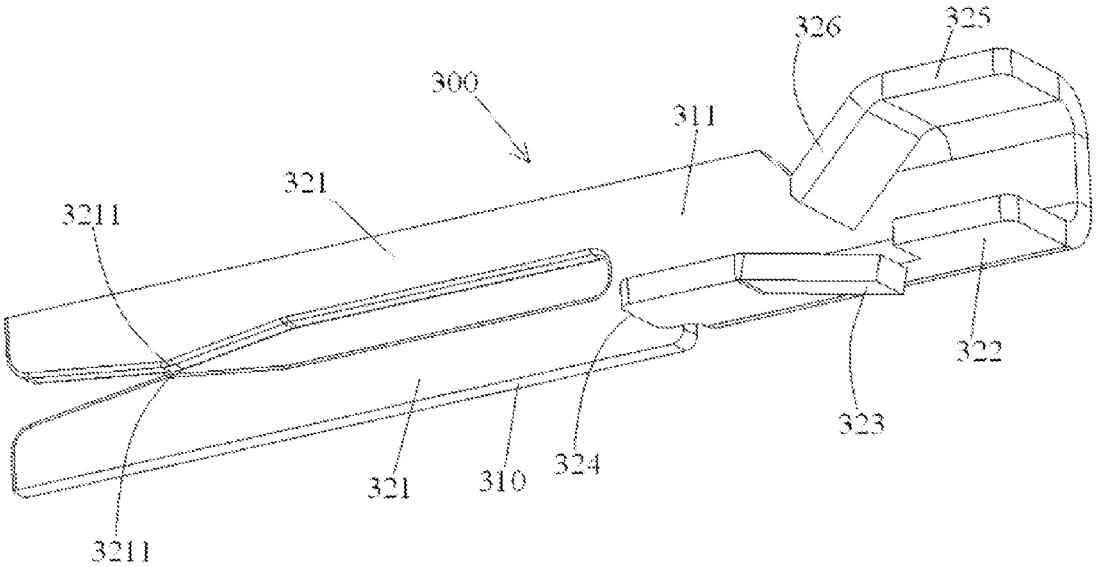
FIG. 5 is perspective view of a contact of an electrical connector according to the invention.

The insulation body 200 has a first side and a second side opposite to the first side in a length direction Y thereof as shown in FIG. 3; and a contact 300 received in the insulation body 200, wherein the contact 300 has a first elastic gripping portion 321 adjacent to the first side of the insulation body 200 and a second elastic gripping portion 322, 325, 326 adjacent to the second side of the insulation body 200 as shown in FIG. 5; and wherein the first and second devices 100, 400 are inserted into the insulation body 200 from the first and second sides, respectively, and gripped by the first and second elastic gripping portions, respectively, so that the first and second devices 100, 400 are electrically connected with each other.

Figure 2:
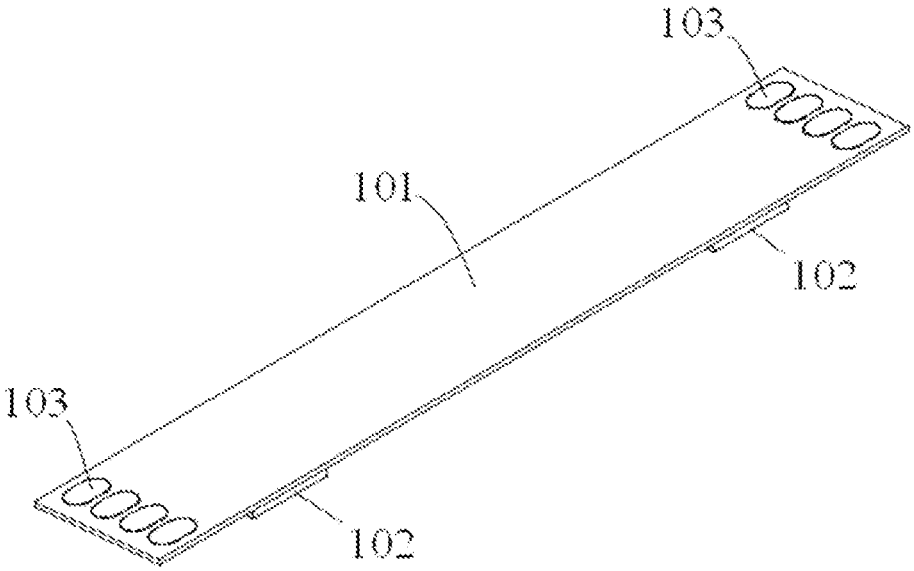
FIG. 2 is a perspective view an electrical contact region on the tape-like LED lamp device of FIG. 1.

As shown in FIGS. 1-2, in the illustrated embodiment, the tape-like electrical device is a tape-like LED lamp device 100. The tape-like LED lamp device 100 includes a tape-like circuit board 101 and at least one LED lamp 102 mounted on the tape-like circuit board 101. An electrical contact region 103, formed on an end portion of the tape-like circuit board 101, makes electrical contact with contact 300.

As shown in FIGS. 3-6, the insulation body 200 has a first side and a second side opposite to the first side in a length direction Y thereof. The contact 300 is received in the insulation body 200. The contact 300 has a first elastic gripping portion 321 adjacent to the first side of the insulation body 200 and a second elastic gripping portion 322, 325, 326 adjacent to the second side of the insulation body 200.

Figure 7:
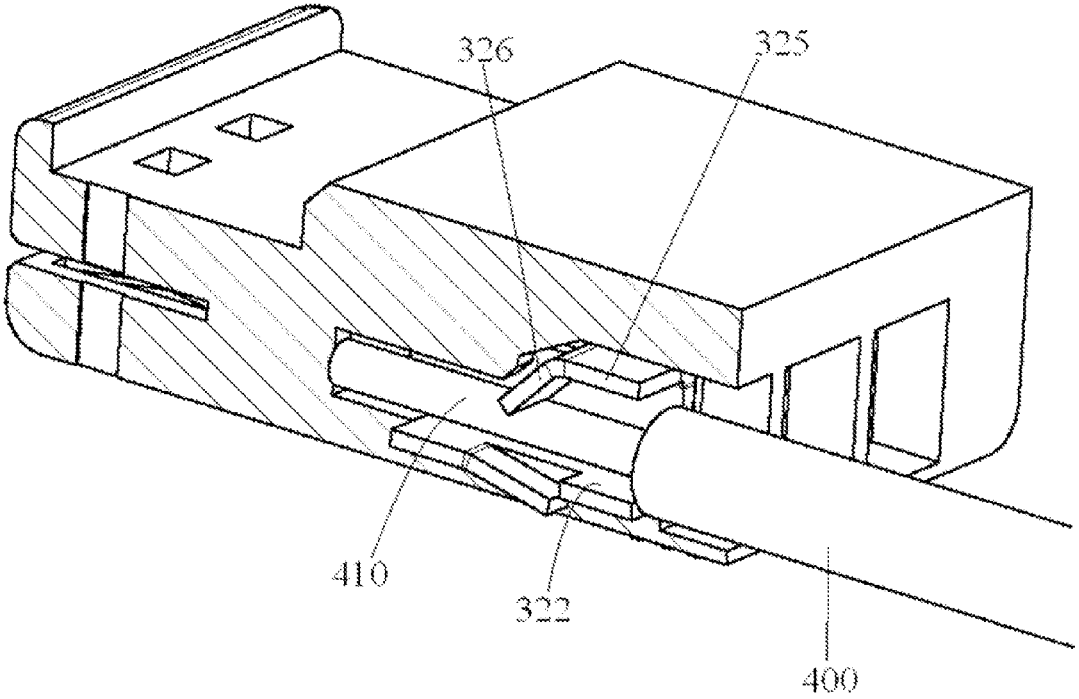
FIG. 7 is another perspective section view of the electrical connector according to the invention showing inserting a wire into the insulation body of FIG. 3.

As shown in FIGS. 7-8, the first device 100 and the second device 400 are inserted into the insulation body 200 from the first side and the second side, respectively. First device 100 and second device 400 are gripped by the first elastic gripping portion 321 and the second elastic gripping portion 322, 325, 326 of the contact 300, respectively, so that the first and second devices 100, 400 are electrically connected with each other.

Referring to FIGS. 3-8, a first receiving slot 211 is formed in the first side of the insulation body 200, and one end of the tape-like electrical device 100 is inserted into the insulation body 200 through the first receiving slot 211. A second receiving slot 220 is formed in the second side of the insulation body 200, and one end of the second device 400, such as a wire, is inserted into the insulation body 200 through the second receiving slot 220. The contact 300 is inserted into and received in the second receiving slot 220.

As shown in FIGS. 3-8, the first receiving slot 211 is shaped to match with an insertion end of the tape-like electrical device 100; and the second receiving slot 220 is shaped to match with the contact 300.

As shown in FIGS. 3-8, the contact 300 includes a plate-like body 310 with a pair of elastic arms 321, 321 having at least one pair of opposite contact portions 3211. The first elastic gripping portion 321 consists of the pair of elastic arms 321, 321. When one end of the tape-like electrical device 100 is inserted into the insulation body 200 through the first receiving slot 211, the electrical contact region 103 of the tape-like electrical device 100 is gripped between the at least one pair of opposite contact portions 3211, so that the tape-like electrical device 100 and the contact 300 electrically contact with each other.

As shown in FIGS. 3-8, the contact 300 further includes a pair of end walls 322, 325 perpendicular to the plate-like body 310, one end wall 325 of the pair of end walls 322, 325 is formed with an elastic pressing finger 326 bent toward the other 322 of the pair of end walls 322, 325. The second elastic gripping portion 322, 325, 326 consists of the pair of end walls 322, 325 and the elastic pressing finger 326. When one end of the wire 400 is inserted into the insulation body 200 through the second receiving slot 220, the conductor 410 of the wire 400 is gripped between the elastic pressing finger 326 and the other 322 of the pair of end walls 322, 325, so that the wire 400 and the contact 300 are in electrical contact with each other.

As shown in FIGS. 3-8, an elastic locking member 323 is formed on the contact 300, and a recess 223 is formed in a side wall of the second receiving slot 220. When the contact 300 is inserted into and received in the second receiving slot 220, the elastic locking member 323 is snapped in the recess 223, so as to lock the contact 300 in the second receiving slot 220. As shown in FIG. 5, the elastic locking member 323 is formed on the other 322 end wall of the pair of end walls 322, 325.

Figure 4:
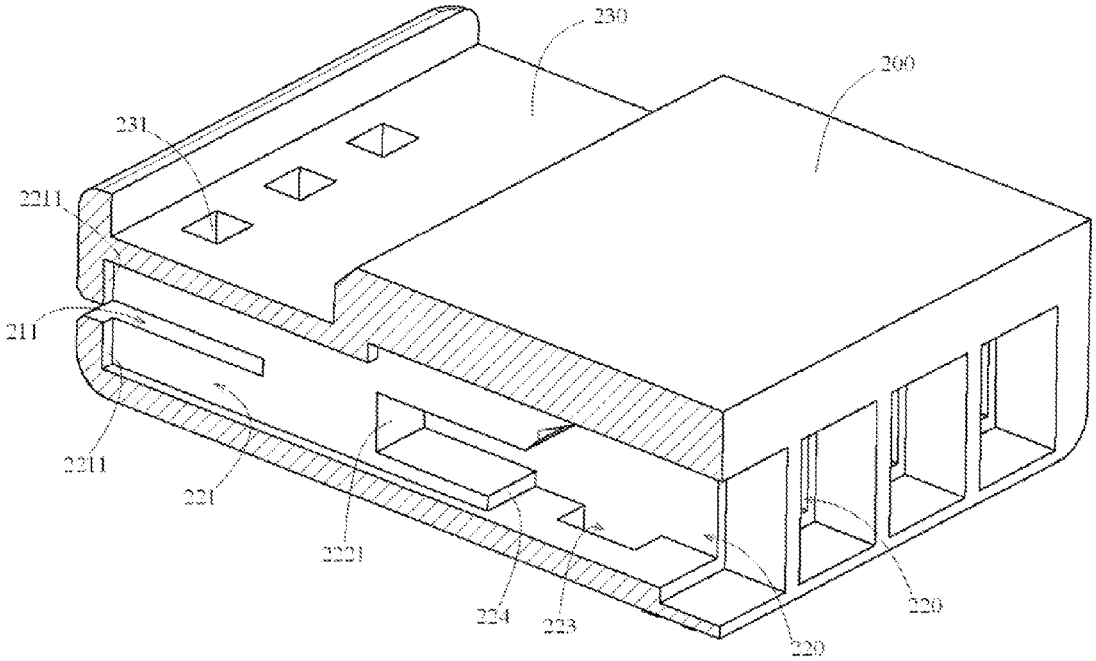
FIG. 4 is a perspective cross section view of the insulation body of FIG. 3.
Figure 6:
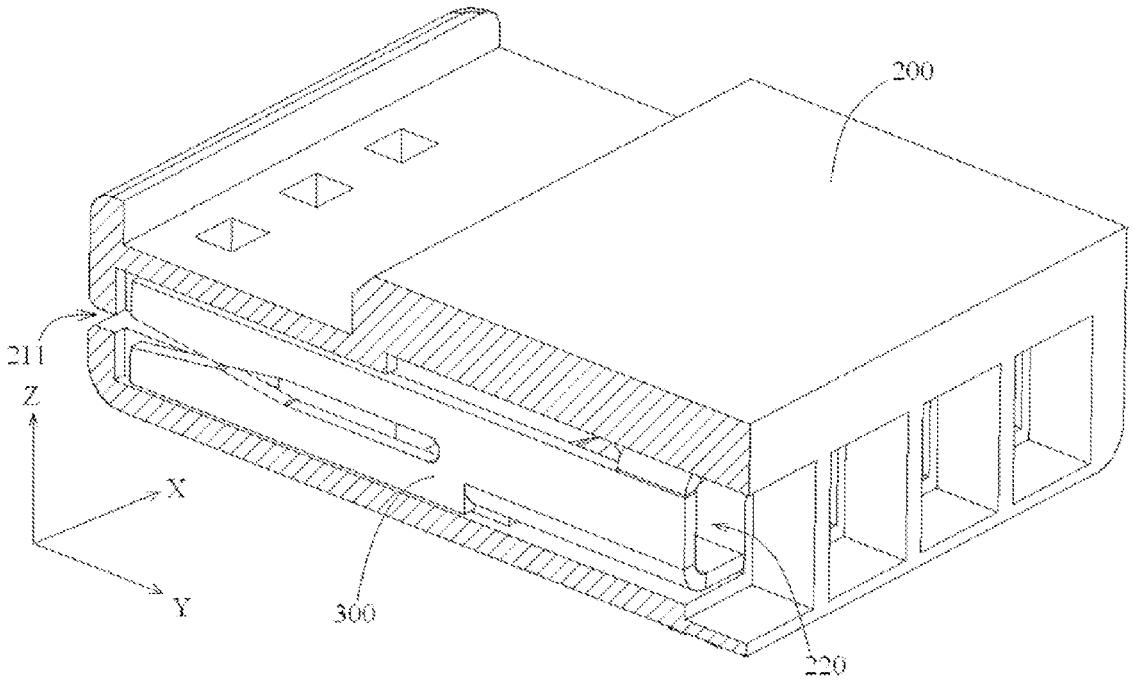
FIG. 6 is perspective view of the showing the electrical connector according to the invention contact of FIG. 5 received in the insulation body of FIG. 4.

As shown in FIGS. 4-6, the contact 300 is formed with a first positioning stop 324, and the second receiving slot 220 is formed with a second positioning stop 224. When the contact 300 is inserted into the second receiving slot 220, the first positioning stop 324 abuts against the second positioning stop 224, so as to limit a depth of inserting the contact 300 into the second receiving slot 220.

As shown in FIGS. 4 and 6, when the contact 300 is inserted into the second receiving slot 220, end surfaces of the pair of elastic arms 321, 321 of the contact 300 are positioned near an end wall 2211 of the second receiving slot 220.

As shown in FIGS. 4 and 7, the second receiving slot 220 is further formed with a third positioning stop 2221. When the wire 400 is inserted into the second receiving slot 220, the end face of the wire 400 abuts against third positioning stop 2221, so as to limit a depth of inserting the wire 400 into the second receiving slot 220.

As shown in FIGS. 4 and 6, the first receiving slot 211 extends in a horizontal plane parallel to a length direction Y and a width direction X of the insulation body 200. A portion 221 of the second receiving slot 220 adjacent to the first receiving slot 211 extends in a vertical plane parallel to the length direction Y and a height direction Z of the insulation body 200. The portion 221 of the second receiving slot 220 and the first receiving slot 211 run through with each other.

In the embodiment shown in FIGS. 3-8, a plurality of first receiving slots 211 and a plurality of second receiving slots 220 are formed in the insulation body 200 and used to electrically connect a plurality of tape-like LED lamp devices 100 to a plurality of wires 400, respectively. However, the invention is not limited to this, and the insulation body 200 may be formed with only a single first receiving slot 211 and a single second receiving slot 220 for electrically connecting a single tape-like LED lamp device 100 to a single wire 400.

Figure 9:
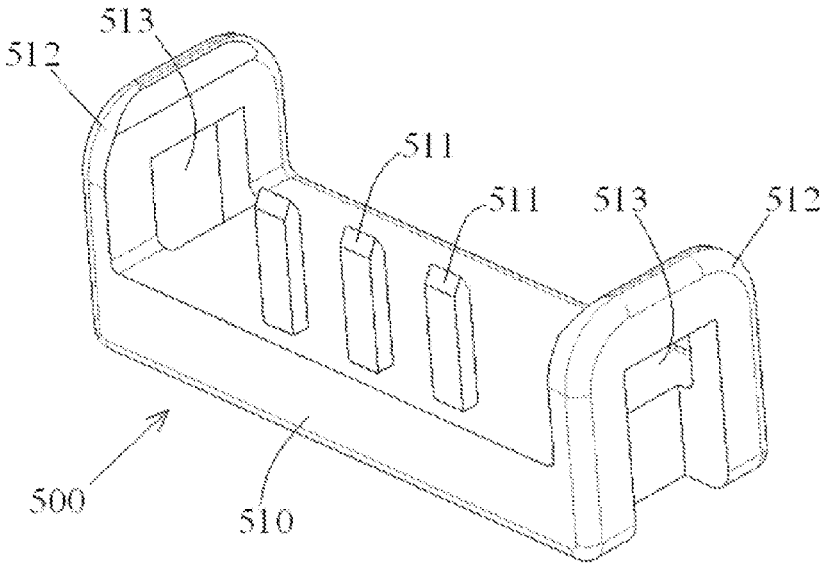
FIG. 9 is a perspective view of a locking piece of the electrical connector according to the invention.
Figure 10:
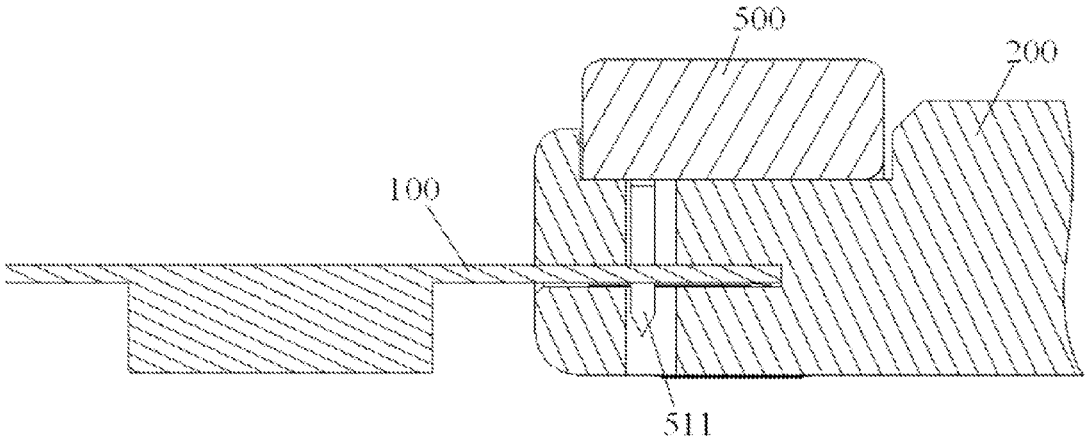
FIG. 10 is a section view of the electrical connector according to the invention showing the tape-like LED lamp device locked on the insulation body using the locking piece of FIG. 9.

As shown in FIGS. 9 and 10, the electrical connector further includes a locking piece 500 mounted on the insulation body 200. The locking piece 500 is formed with one or more piercing pins 511 thereon. One or more pin receiving passageways 231 extending in the height direction Z is formed in the insulation body 200. The pin receiving passageway 231 runs through the respective first receiving slot 211. When the locking piece 500 is mounted on the insulation body 200, the piercing pin 511 enters into the respective pin receiving passageway 231 and pierces through the tape-like electrical device 100, so as to fix the respective tape-like electrical device 100 on the insulation body 200.

As shown in FIGS. 3-4, 6, 9-10, an installation slot 230 is formed in the top of the insulation body 200. A body 510 of the locking piece 500 is embedded in the installation slot 230. The insulation body 200 and the locking piece 500 are latched together by means of latching features 201, 512 formed thereon.

As shown in FIGS. 3 and 9, in an exemplary embodiment, the latching features 201, 512 includes a pair of elastic latches 512 formed on both sides of the body 510 of the locking piece 500, and a pair of protrusions 201 formed on both sides of the insulation body 200 in the width direction X. The protrusion 201 is adapted to be snapped into a notch 513 formed in the elastic latch 512, so as to reliably hold the locking piece 500 on the insulation body 200.

Now with reference to FIGS. 11-16, another embodiment of an electrical connector according to the invention will be discussed. As shown in FIGS. 11-16, the electrical connector is used to electrically connect two tape-like electrical devices (for example, two tape-like LED lamp devices shown in FIGS. 1-2), and generally includes an insulation body 200' and a contact 300' for receiving two tape-like LED lamp devices 100', 600'.

As shown in FIGS. 11-14, a first receiving slot 211' is formed in a first side of the insulation body 200', and one end of the first tape-like electrical device 100' is inserted into the insulation body 200' through the first receiving slot 211'. A second receiving slot 220' is formed in a second side of the insulation body 200', and the contact 300' is inserted into the insulation body 200' through the second receiving slot 220'. A third receiving slot 212' is formed in the second side of the insulation body 200', and one end of the second tape-like electrical device 600' is inserted into the insulation body 200' through the third receiving slot 212'.

As shown in FIGS. 11-14, the first receiving slot 211' is shaped to match with an insertion end of the first tape-like electrical device 100'. The second receiving slot 220' is shaped to match with the contact 300'. The third receiving slot 212' is shaped to match with an insertion end of the second tape-like electrical device 600'.

As shown in FIGS. 11-14, the contact 300' includes a plate-like body 310'. The plate-like body 310' includes a pair of first elastic arms 311', 311' and a pair of second elastic arms 312', 312'. The pair of first elastic arms 311', 311' have at least one pair of opposite first contact portions 3111'. The first elastic gripping portion consists of the pair of first elastic arms 311', 311'. The pair of second elastic arms 312', 312', opposite to the pair of first elastic arms 311', 311', have at least one pair of opposite second contact portions 3121'. The second elastic gripping portion consists of the pair of second elastic arms 312', 312'.

As shown in FIGS. 11-14, when the first tape-like electrical device 100' and the second tape-like electrical device 600' are inserted into the insulation body 200', the electrical contact region of the first tape-like electrical device 100' is gripped between the at least one pair of opposite first contact portions 3111', and the electrical contact region of the second tape-like electrical device 600' is gripped between the at least one pair of opposite second contact portions 3121', so that the contact 300' electrically contacts the first and second devices 100', 600'.

As shown in FIGS. 11-14, an elastic locking member 323' is formed on the contact 300', and a recess (not shown) is formed in a side wall of the second receiving slot 220'. When the contact 300' is inserted into and received in the second receiving slot 220', the elastic locking member 323' is snapped in the recess, so as to lock the contact 300' in the second receiving slot 220'.

As shown in FIGS. 11-14, the first receiving slot 211' extends in a horizontal plane parallel to a length direction Y and a width direction X of the insulation body 200'. The second receiving slot 220' extends in a vertical plane parallel to the length direction Y and a height direction Z of the insulation body 200'. The third receiving slot 212' extends in the horizontal plane parallel to the length direction Y and the width direction X of the insulation body 200'. One portion (for receiving the first elastic arm 311') of the second receiving slot 220' runs through the first receiving slot 211', and the other portion (for receiving the second elastic arm 312') of the second receiving slot 220' runs through the third receiving slot 212'.

As shown in FIGS. 11-14, a plurality of first receiving slots 211', a plurality of second receiving slots 220' and a plurality of third receiving slots 212' are formed in the insulation body 200', so as to electrically connect a plurality of first tape-like electrical device 100' to a plurality of second tape-like electrical device 600'.

As shown in FIGS. 11-16, the electrical connector further includes a first locking piece 500' and a second locking piece 500' mounted on the insulation body 200'. In the shown embodiment, the first locking piece 500' is configured to be exactly the same as the second locking piece 500'. The first and second locking pieces 500' each are formed with one or more piercing pins 511' thereon. One or more first pin receiving passageways 231' and one or more second pin receiving passageways 241', corresponding to one or more piercing pins 511' of the first and second locking pieces 500' and extending in the height direction Z, are formed in the insulation body 200'. The first pin receiving passageway 231' and the second pin receiving passageway 241' run through the first receiving slot 211' and the third receiving slot 212', respectively. When the first and second locking pieces 500' are mounted on the insulation body 200', the piercing pins 511' enter into the first and second pin receiving passageways 231', 241' and pierce through the first and second tape-like electrical devices 100', 600', respectively, so as to fix the first and second tape-like electrical devices 100', 600' on the insulation body 200', respectively.

Figure 11:
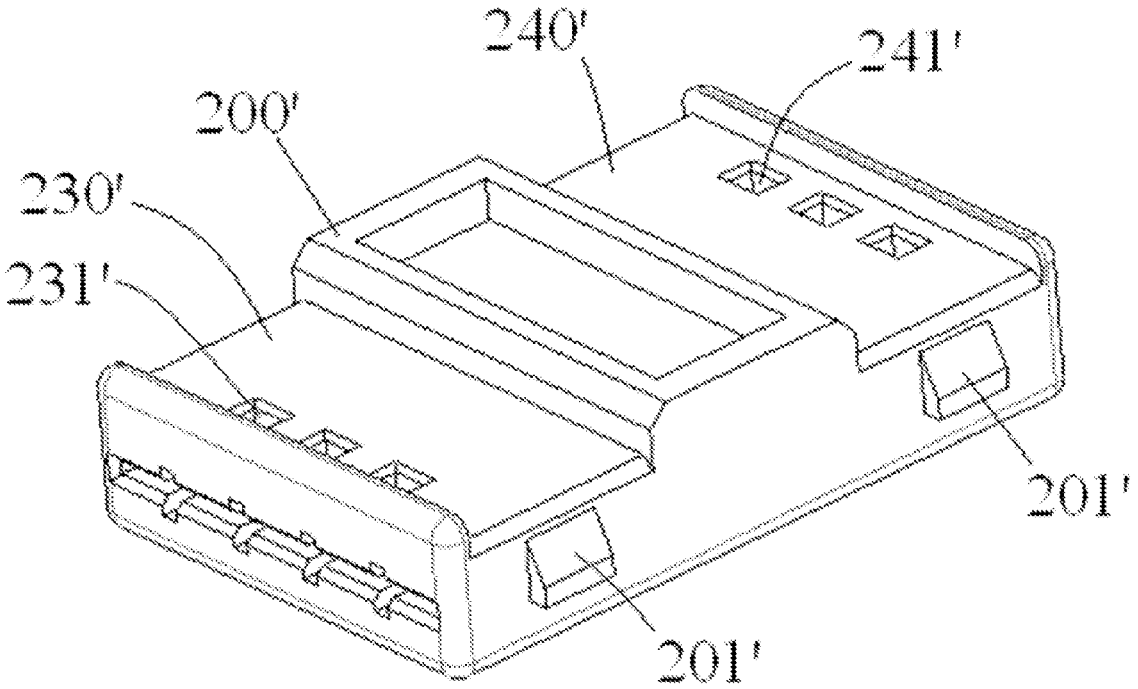
FIG. 11 is a perspective view of an insulation body of another electrical connector according to the invention.
Figure 12:
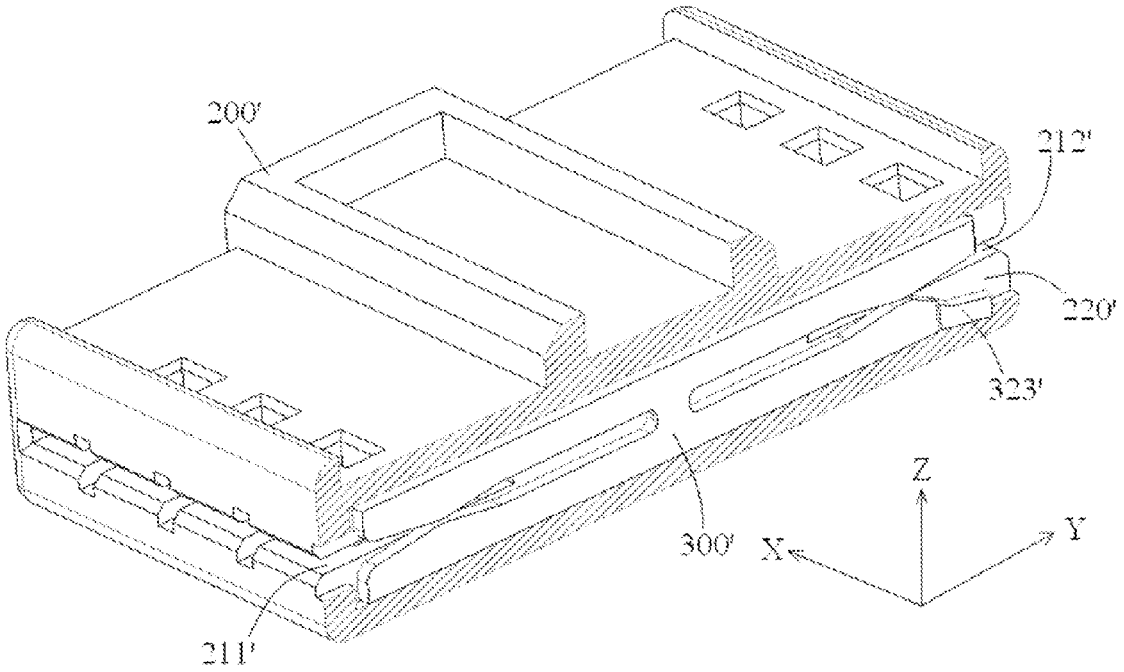
FIG. 12 is a cross section view of the electrical connector of FIG. 11 showing a contact received in the insulation body.
Figure 13:
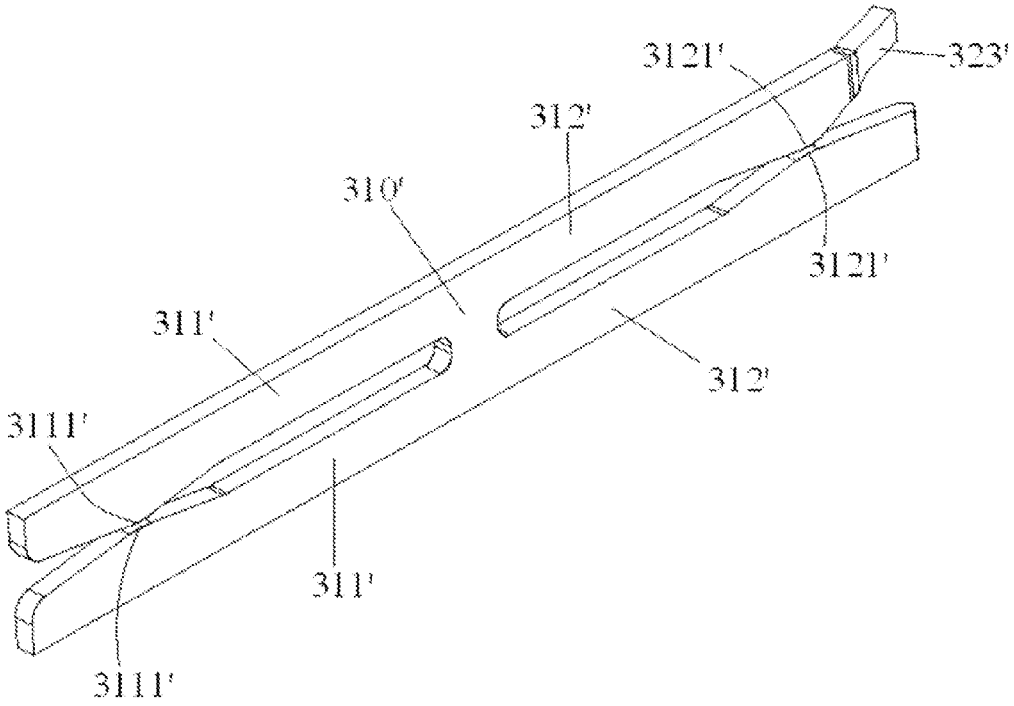
FIG. 13 is a perspective view of the contact of FIG. 12.
Figure 14:
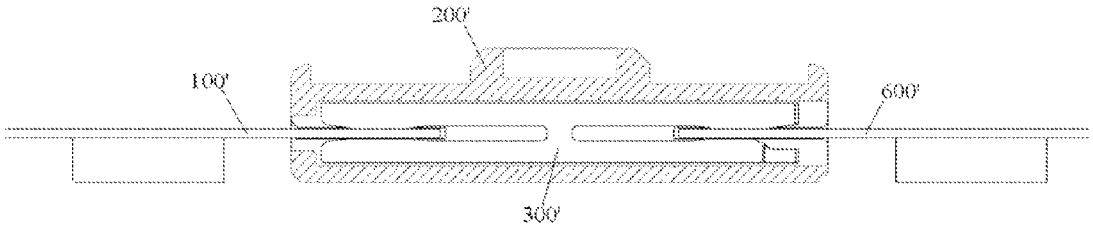
FIG. 14 is a section view of the electrical connector of FIG. 11 showing insertion of two tape-like LED lamp devices.
Figure 15:
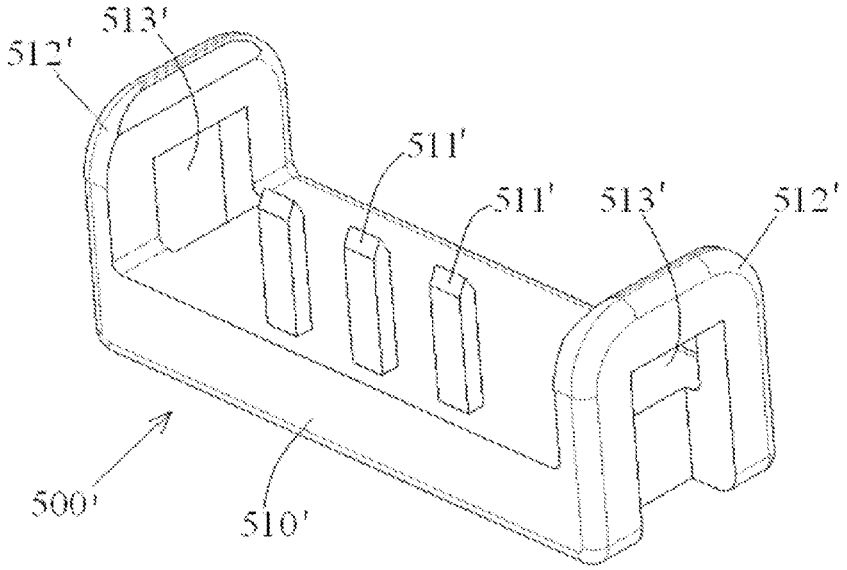
FIG. 15 is a perspective view of a locking piece of the electrical connector of FIG. 11.
Figure 16:
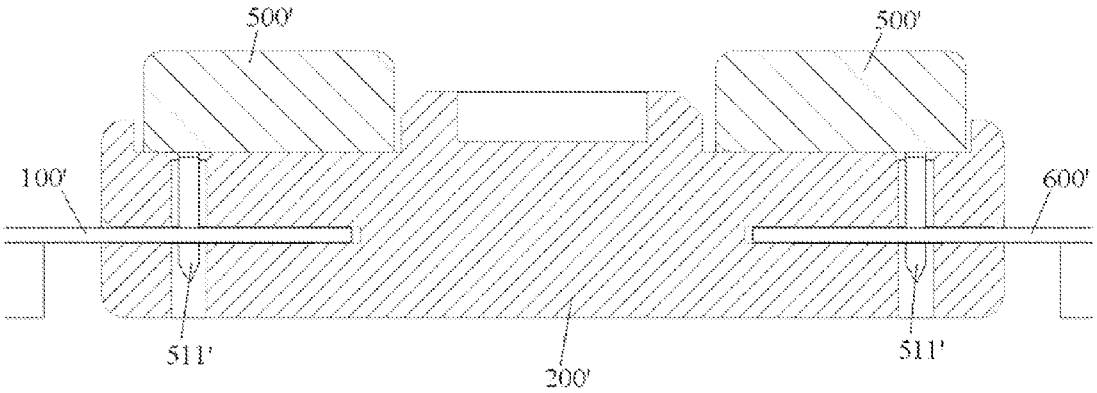
FIG. 16 is a section view of the electrical connector of FIG. 11 showing the tape-like LED lamp devices locked on the insulation body using the locking piece of FIG. 15.

As shown in FIGS. 11, and 15-16, a first installation slot 230' and a second installation slot 240' are formed in the top of the insulation body 200'. A body 510' of the first locking piece 500' and a body 510' of the second locking piece 500' are embedded in the first installation slot 230' and the second installation slot 240', respectively. The insulation body 200' and each of the locking pieces 500' are latched together by means of latching features 201', 512' formed thereon.

As shown in FIGS. 11, and 15-16, in the shown embodiment, the latching features 201', 512' includes a pair of elastic latches 512' formed on both sides of the body 510' of the locking piece 500', and a pair of protrusions 201' formed on both sides of the insulation body 200' in the width direction X. The protrusion 201' is adapted to be snapped into a notch 513' formed in the elastic latch 512', so as to reliably hold the locking piece 500' on the insulation body 200'. It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. An electrical connector comprising:

an insulation body having a first receiving slot disposed along a first side and a second receiving slot disposed along a second side positioned opposite to the first side;

a contact received in the second receiving slot and having a first elastic gripping portion adjacent to the first side of the insulation body and a second elastic gripping portion adjacent to the second side of the insulation body; and a locking piece having a piercing pin extending outward there from.

2. The electrical connector according to claim 1, wherein the first receiving slot is a tape-like electrical device receiving slot.

3. The electrical connector according to claim 1, wherein the shape of the second receiving slot corresponds with the contact.

4. The electrical connector according to claim 3, wherein the contact includes a plate-like body having a pair of elastic arms with a pair of opposite contact portions.

5. The electrical connector according to claim 4, wherein the contact further includes a pair of end walls positioned perpendicular to the plate-like body.

6. The electrical connector according to claim 5, wherein one of the pair of end walls includes an elastic pressing finger bent toward the other of the pair of end walls.

7. The electrical connector according to claim 6, further comprising an elastic locking member formed on the contact.

8. The electrical connector according to claim 7, further having a recess disposed along a side wall of the second receiving slot.

9. The electrical connector according to claim 8, wherein the elastic locking member is positioned on the other of the pair of end walls.

10. The electrical connector according to claim 9, wherein the contact further includes a first positioning stop and the second receiving slot includes a second positioning stop abutting the first positioning stop when the contact is in the second receiving slot.

11. The electrical connector according to claim 10, wherein the second receiving slot further includes a third positioning stop.

12. The electrical connector according to claim 1, wherein the insulation body has a pin receiving passageway extending into the first receiving slot.

13. The electrical connector according to claim 12, wherein the insulation body receives the locking piece and the piercing pin enters into the pin receiving passageway.

14. The electrical connector according to claim 13, wherein the insulation body further has a locking piece installation slot.

15. The electrical connector according to claim 14, wherein the insulation body includes a body latch and the locking piece has a locking latch corresponding with the body latch.

16. The electrical connector according to claim 15, wherein the body latch is a protrusion and the locking latch is an elastic latch having a protrusion receiving notch.

17. The electrical connector according to claim 15, further having a third receiving slot disposed along the second side of the insulation body.

18. The electrical connector according to claim 16, wherein the third receiving slot is a second device receiving slot.

19. The electrical connector according to claim 1, wherein the contact includes a plate-like body having a pair of first device elastic arms and a pair of second device elastic arms positioned opposite to the pair of first device elastic arms.

20. The electrical connector according to claim 19, wherein the contact further includes an elastic locking member positioned on a side of the thereof.

21. The electrical connector according to claim 20, further having a recess is formed in a side wall of the second receiving slot and corresponding with the elastic locking member.

22. The electrical connector according to claim 21, further comprising a second locking piece with a second piercing pin.

23. The electrical connector according to claim 22, wherein the insulation body has a first pin receiving passageway positioned on a first side and extending into the first receiving slot and a second pin receiving passageway positioned on the second side and extending into the third receiving slot.

24. The electrical connector according to claim 23, wherein the insulation body further has a locking piece installation slot.

25. The electrical connector according to claim 24, wherein the insulation body includes a body latch and the locking piece or the second locking piece includes a locking latch corresponding with the body latch.

26. The electrical connector according to claim 25, wherein the body latch is a protrusion and the locking latch is an elastic latch having a protrusion receiving notch.

* * * * *